US005815122A

United States Patent [19]

Nurnberger et al.

[11] Patent Number: 5,815,122

[45] Date of Patent: Sep. 29, 1998

[54] SLOT SPIRAL ANTENNA WITH INTEGRATED BALUN AND FEED

[75] Inventors: Michael W. Nurnberger; John L. Volakis, both of Ann Arbor, Mich.

[73] Assignee: The Regents of the University of Michigan, Ann Arobr, Mich.

[21] Appl. No.: 584,496

[22] Filed: Jan. 11, 1996

[51] Int. Cl.[6] ..... H01Q 13/10; H01Q 1/36

[52] U.S. Cl. ..... 343/767; 343/770; 343/895

[58] Field of Search ..... 343/767, 770, 343/895, 700 MS, 789; H01Q 13/10, 1/36

[56] References Cited

U.S. PATENT DOCUMENTS

| | | | |
|---|---|---|---|
| 2,863,145 | 12/1958 | Turner | 343/767 |
| 2,929,064 | 3/1960 | Kelly | 343/771 |
| 2,958,081 | 10/1960 | Dyson | 343/895 |
| 3,509,465 | 4/1970 | Andre et al. | 325/373 |
| 3,587,106 | 6/1971 | Crooks, Jr. et al. | 343/895 |
| 3,618,114 | 11/1971 | Dietrich | 343/895 |
| 3,633,210 | 1/1972 | Westerman et al. | 343/895 |
| 4,161,737 | 7/1979 | Albright | 343/895 |
| 4,315,266 | 2/1982 | Ellis, Jr. | 343/895 |
| 4,319,248 | 3/1982 | Flam | 343/895 |
| 4,525,720 | 6/1985 | Corzine et al. | 343/895 |
| 4,559,539 | 12/1985 | Markowitz et al. | 343/895 |
| 4,605,934 | 8/1986 | Andrews | 343/895 |
| 4,630,064 | 12/1986 | Andrews et al. | 343/895 |
| 4,823,145 | 4/1989 | Mayes et al. | 343/700 MS |
| 4,975,711 | 12/1990 | Lee | 343/770 |
| 5,146,234 | 9/1992 | Lalezari | 343/895 |
| 5,175,561 | 12/1992 | Goto | 343/769 |
| 5,313,216 | 5/1994 | Wang et al. | 343/700 MS |
| 5,327,146 | 7/1994 | Jeon | 343/700 MS |

OTHER PUBLICATIONS

Dual–Spiral Slot Antennas, K. Hirose, Prof. H. Nakano, IEE Proceedings–H, vol. 138. No. 1 Feb. 1991.

*Primary Examiner*—Hoanganh T. Le
*Attorney, Agent, or Firm*—Harness, Dickey & Pierce, PLC

[57] ABSTRACT

A slot spiral antenna with a planar integrated balun and feed. The slot spiral is produced using standard printed circuit techniques and comprises a dielectric substrate having a conductive layer which is etched to form the radiating slot spiral. An integrated microstrip feed is included to provide a balanced feed to the slot spiral. Impedance matching is performed between the microstrip feed and the slotline of the slot spiral to maximize energy transfer. A shallow reflecting cavity is included to limit the spiral radiation to one direction. The described antenna apparatus provides a simple, broadband spiral antenna suitable for incorporating into the skin of a moving vehicle.

20 Claims, 7 Drawing Sheets

SLOT SPIRAL ANTENNA WITH INTEGRATED BALUN AND FEED

This invention was made with U.S. Government support under grant NAG 1-1478 awarded by the National Aeronautics and Space Administration-Langley Research Center. The U.S. Government has certain rights in this invention pursuant to the above-identified grant.

FIELD OF THE INVENTION

The present invention relates to planar, broadband antennas. More particularly, the present invention relates to slot spiral antennas having an integrated balun and feed.

BACKGROUND OF THE INVENTION

Spiral antennas are particularly known for their ability to produce very broadband, almost perfectly circularly-polarized radiation over their full coverage region. Because of this polarization diversity and broad spatial and frequency coverage, many different applications exist, ranging from military surveillance, ECM, and ECCM uses, to numerous commercial and private uses, including the consolidation of multiple low gain communications antennas on moving vehicles.

Generally, spiral antenna are made of wire. For the typical wire spiral antenna, the performance advantages mentioned above come at the price of size and complexity. While the radiating elements of a wire spiral may be planar, the feed network and balun structure generally are not, and combine to add weight, depth, and significant complexity to the system. Furthermore, because a planar spiral antenna radiates bi-directionally, an absorbing cavity is generally used to eliminate the radiation in one direction, adding even more depth to the antenna. While some designs exist that integrate the feed and balun into the cavity and reduce the complexity somewhat, the cavity is still at least a quarter-wavelength deep at the lowest frequency of operation, adding significant thickness to the overall antenna structure.

The above-mentioned limitations in the prior art make conformal mounting in the skin of a vehicle difficult for prior art spiral antennas. Conformal mounting generally results in poor pattern coverage at angles far off the axis of the spiral due to the metallic skin of the vehicle. Furthermore, the size and weight of prior art spiral antennas, including cavity backing and balun structures, makes conformal mounting prohibitively difficult.

Thus there is a need for an improved simple, broadband, spiral antenna. There is a further need for a spiral antenna which can easily be incorporated into the skin of a moving vehicle in a streamlined/aerodynamic manner, without hindering the radiation pattern performance of the antenna. There is also a need for a unidirectional spiral antenna with an integrated balun and feed which is simple, thin and light. There is a still further need for a spiral antenna having a balanced feed and properly terminated arms which can match any input impedance.

SUMMARY OF THE INVENTION

The present invention provides a slot spiral antenna with an integrated matched planar balun and feed.

One object of the present invention is to provide an improved simple broadband slot spiral antenna.

Another object of the present invention is to provide a spiral antenna which can easily be incorporated into the skin of a moving vehicle in a streamlined/aerodynamic manner, without hindering the radiation of the antenna.

Still another object of the present invention is to provide a slot spiral antenna which be easily miniaturized and which can shape and steer its radiation pattern.

A further object of the present invention is to provide a unidirectional spiral antenna with an integrated balun and feed which is simple, thin, light and flexible.

A still further object of the present invention is to provide a spiral antenna having a balanced feed, impedance matching both between the feed and the radiating element and at the input port and properly terminated antenna arms.

In order to achieve the foregoing objects, the present invention provides a slot spiral antenna with an integrated planar balun and feed. The slot spiral antenna is produced using standard printed circuit techniques. It comprises a conducting layer formed on a material substrate. The conducting layer is etched or milled to form a radiating spiral slot. Any type or combination of types of spiral may be used, however, the preferred embodiment uses an Archimedean spiral. If necessary, to limit the spiral radiation to one direction, a cavity may also be included.

The balun structure comprises a microstrip line that winds toward the center of the slot spiral. At the center of the slot spiral, the feed is executed by breaking the ground plane of the microstrip line with the spiral slot. To maximize the transfer of energy from the microstrip line to the slotline, the impedance of the slotline is chosen to be twice that of the microstrip line. At the feed point, the microstrip line sees the slotline as a pair of shunt branches, and thus the slotline impedance yields a perfect match at the feed. The microstrip line continues past the microstrip/slotline transition and winds back out from the center of the slot spiral where it is terminated in any one of several ways.

Further objects, features and advantages of the invention will become apparent from a consideration of the following description and the appended claims when taken in connection with the accompanying drawings.

DETAILED DESCRIPTION OF THE PREFERRED EMBODIMENTS

Preferred embodiments of the slot spiral antenna with integrated balun and feed are described herebelow with reference to the drawings.

Figure 1:
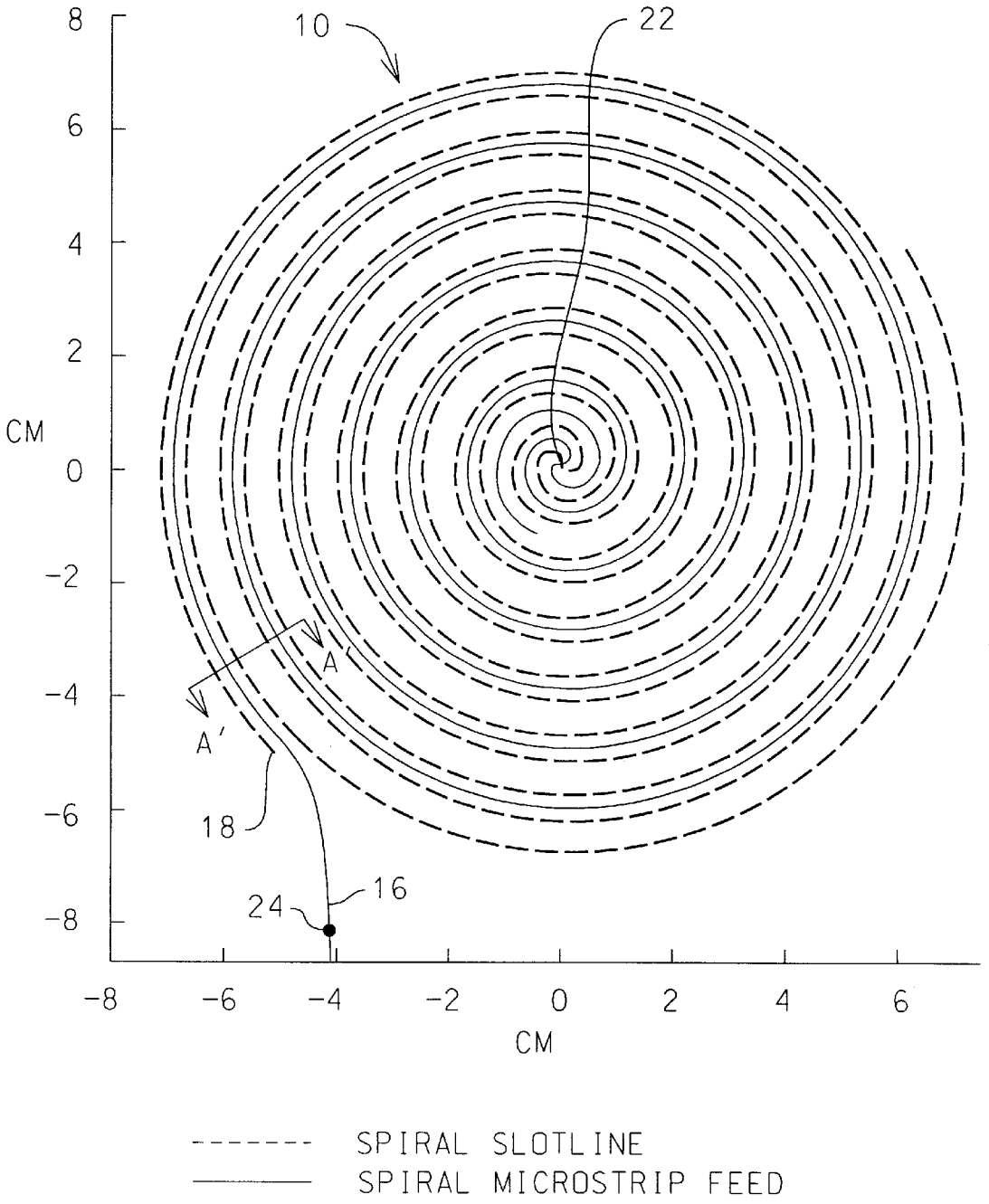
FIG. 1 is a schematic diagram of the spiral slot antenna and microstrip balun/feed of the present invention.
Figure 2:
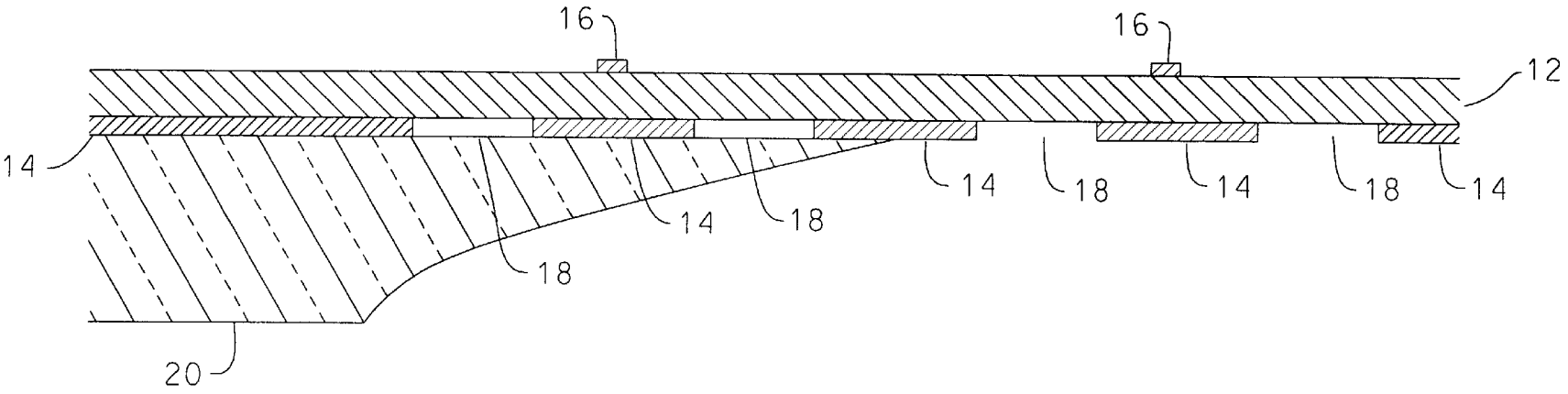
FIG. 2 is an enlarged cross-sectional view of the spiral antenna of FIG. 1 taken along A—A' in FIG. 1.

Referring to FIGS. 1 and 2, the slot spiral antenna apparatus of the present invention, indicated generally at 10, includes a material substrate 12, having conductive layers on both sides. On one side, a portion of the conductive layer 14 is removed to produce a spiral slotline 18 (shown in phantom) exposing the substrate 12 beneath the conductive layer 14. On the other side, a portion of the conducting layer is removed to produce a spiral microstrip line 16. The procedures used to remove these portions of the conducting layers may be any one of the common techniques used to produce printed circuit boards such as etching, milling or other standard printed circuit techniques. To maintain a low axial ratio (ratio of the two orthogonally polarized radiated field components in phase quadrature) over the entire antenna bandwidth, the outer arms of the spiral are loaded with electromagnetic absorber 20 as shown in FIG. 2. The absorber acts to suppress wave reflections from the spiral's outer terminals which can contaminate the traveling wave in the slots and cause both pattern and axial ratio deterioration, as well as unpredictable input impedance. Tapering of the absorber thickness, as shown in FIG. 2, can improve it's effectiveness by making the change in material seen by the traveling wave more gradual. Alternatively, the slot arms may be terminated by using other resistive layer, deposition of lossy material, resistor cards or other similar materials. Furthermore, the arms may be modified, ie. slot width, to help with termination or termination may be accomplished using lumped elements.

The microstrip line 16 is used to provide a balanced feed to the spiral slotline 18 in the form of an infinite balun. The microstrip line 16 is wound toward the center of the slot spiral antenna from the periphery of the antenna and composes both the feed network and infinite balun structure for the antenna. The microstrip line 16 continues past the microstrip/slotline transition 22, and winds back out from the center of the slot spiral. It can extend any multiple of a quarter wavelength at a desired frequency or out to the edge where it is resistively terminated. Alternatively, other reactive or lossy termination can be used anywhere on the spiral for increased frequency coverage. By integrating the balun into the antenna, the proposed feed design serves to minimize the antenna size. In this manner, the balun and feed structure can be integrated into the apparatus to form a planar radiating structure. The proposed feed structure generates equal signal strengths at the feed point each traveling in opposite directions. Also, the proposed feed can be generalized to slot spirals having any number of arms and still retain the infinite balun property.

The microstrip line 16 is further configured to maximize the transfer of energy to the slotline 18 by tuning its characteristic impedance. In order to accomplish maximum energy transfer, the characteristic impedance of the microstrip line 16 is set at one half the characteristic impedance of the slotline 18. Because the microstrip line 16 is configured opposite the remaining conductive layer 14 in the spiral, the conductive layer 14 acts as a ground plane for the microstrip line 16. As shown in FIG. 1, the feed is executed by breaking the ground plane of the microstrip line 16 with the slotline 18 at the center of the spiral. Because the microstrip line 16 crosses the slotline 18 at the center feed point 22, electromagnetic coupling occurs between the microstrip line 16 and the slotline 18. In this manner the slotline 18 is excited without contact between the layers . At the feed point 22, the microstrip line 16 sees the slotline 18 as a pair of shunt impedances, and thus a perfect match is achieved at the feed point 22 provided the microstrip line's impedance is equal to one half the impedance of the slotline. To achieve this impedance match at the center of the slot spiral, the microstrip feed 16 can be tapered to a given strip width and likewise the spiral slotline 18 width can be adjusted slightly without noticeable compromise in the antenna performance.

The microstrip line 16 can be excited using any conventional manner and in a manner compatible with the surrounding electronic system. One approach is to connect an external source or receiver to the microstrip balun/feed network by attaching a connector at point 24, in FIG. 1, and fastening a coax cable between this connection and the source or receiver. The microstrip line connection point 24 is preferably located outside the spiral's periphery. This connection may be either direct or through a connector. Another possibility is to use, at point 24, an aperture coupled configuration through an appropriate waveguide or secondary substrate layer.

Figure 6:
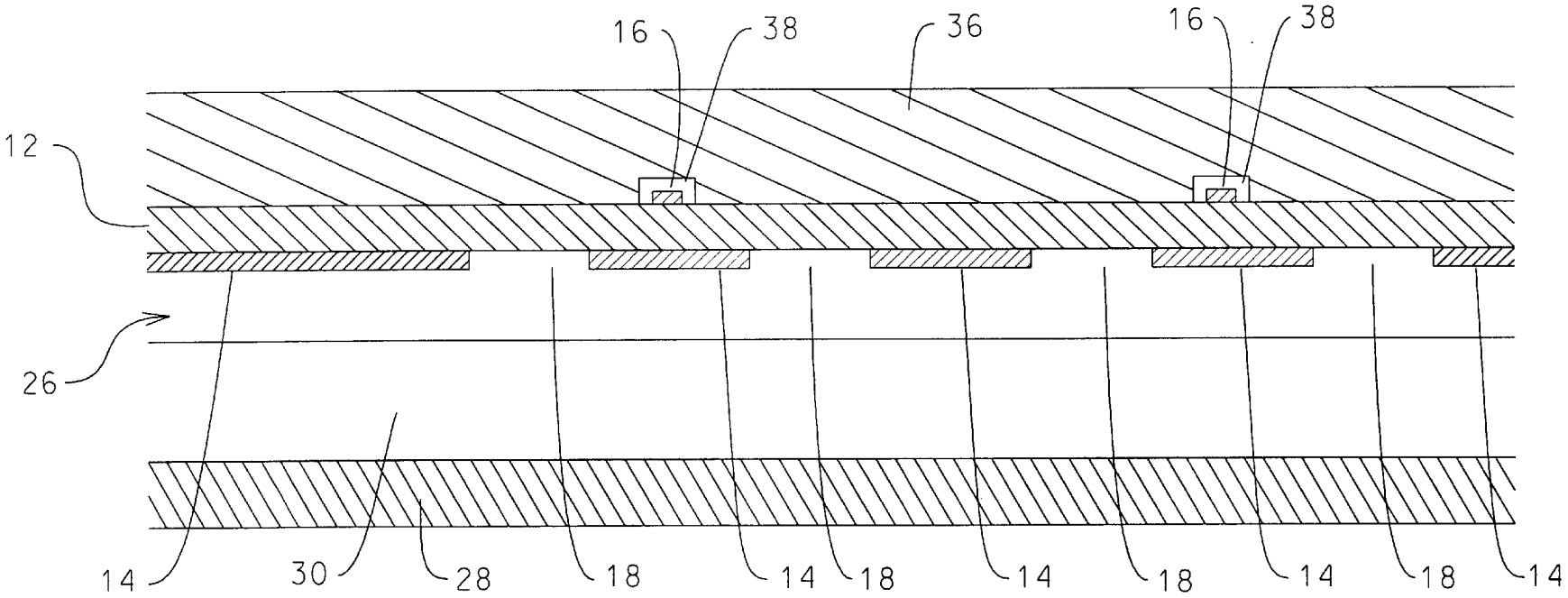
FIG. 6 is an enlarged cross-sectional view of an alternative embodiment of a cavity-backed slot spiral, including a microstrip superstrate.

A shallow reflecting cavity, indicated generally at 26 in FIG. 6, can be included to give the antenna unidirectional propagation properties. Because the radiating slot fields are equivalent to magnetic currents flowing along the winding slots 18 in the direction of propagation, the radiation is enhanced by the presence of a reflecting cavity 26 since the wave radiated into the cavity 26 is reflected by a cavity backing 28 in phase with the corresponding outward radiating wave. Thus, the cavity 26 can be extremely shallow (typically less than a 1/10th of a wavelength) provided it does not short the slot field. This is an important characteristic of the design because, by enabling the antenna as a whole to be very thin, it permits mounting of the antenna in the vehicle's outer skin. The traditional wire spiral antenna relies on the radiation of electric currents (flowing on the conducting spiral strips) rather than magnetic currents. As is well known, electric currents generate cavity-reflected waves that are out of phase with the outward radiated wave unless the cavity is of sufficient depth (typically ¼ of a wavelength) or is loaded with absorber which covers the entire cavity backing thus adding unnecessary depth to the cavity.

The cavity 26 of the present invention may also be filled with a low loss material (dielectric or magnetic) substrate 30. The substrate filling 30 serves to shift the antenna operation to lower frequencies and this is equivalent to reducing the antenna diameter. This also allows for the use of an even shallower cavity 26.

Figure 3:
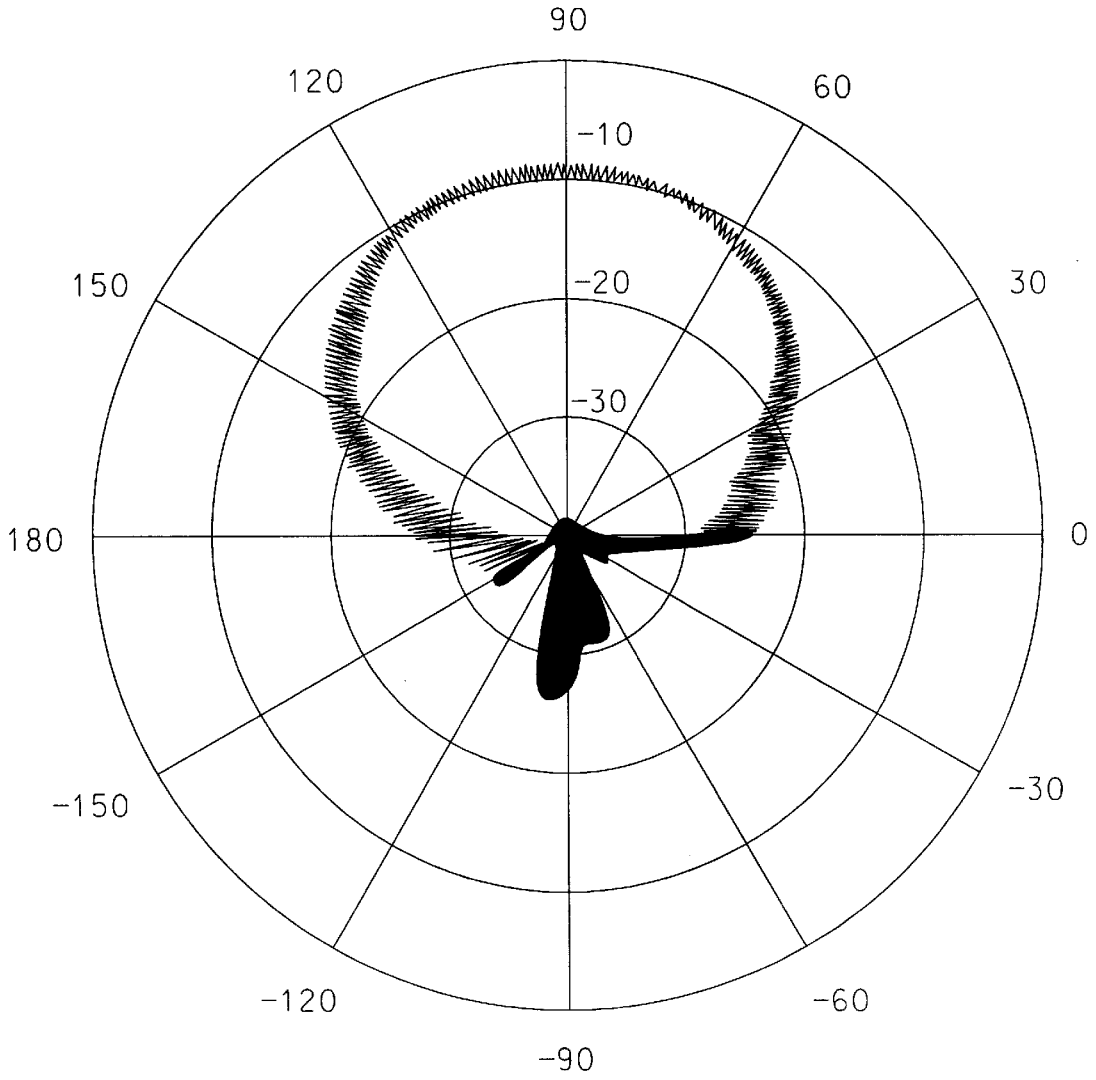
FIG. 3 is a radiation pattern diagram of the slot spiral antenna of FIG. 1 at 1200 MHZ.

In the preferred embodiment, the dielectric substrate 12 is 10 mils thick and has a dielectric constant of 4.5. The spiral form used is an Archimedean spiral with an outer diameter of 6 inches and a growth rate of 0.166, however any spiral form or combination of forms may be used with any number of turns or growth rates. The spiral slotline 18 is configured to have an impedance of 90 Ω and is designed to be 28 mils wide, with a slot center-to-center separation of 205 mils. The microstrip line 16 acts as the feed and has a characteristic impedance of 50 Ω at connecting point 24, where it is 18 mils wide. The microstrip 16 tapers to 65 Ω (11 mils wide) in the active portion of the spiral, thereby minimizing its width and thus also any unwanted coupling to the slotline 18, and then tapers back out to 45 Ω at the center of the spiral to match the impedance of the radiating spiral slotline 18. It then continues to wind back out from the center, and is terminated at such a position and in such a manner as to optimize the impedance match both at connection point 24 and at the microstrip-to-slotline transition 22 at the center of the spiral. The reflecting cavity 26 is configured to be 200 mils deep (0.015 λ@900 MHZ). FIG. 3 illustrates a sample radiation pattern obtained for the above described preferred embodiment at 1200 MHZ.

The aforementioned design can be modified to embody alternative feed structures which retain the same physical principles of operation. Examples of such alternative feeds are illustrated in FIGS. 4 and 5.

Figure 4:
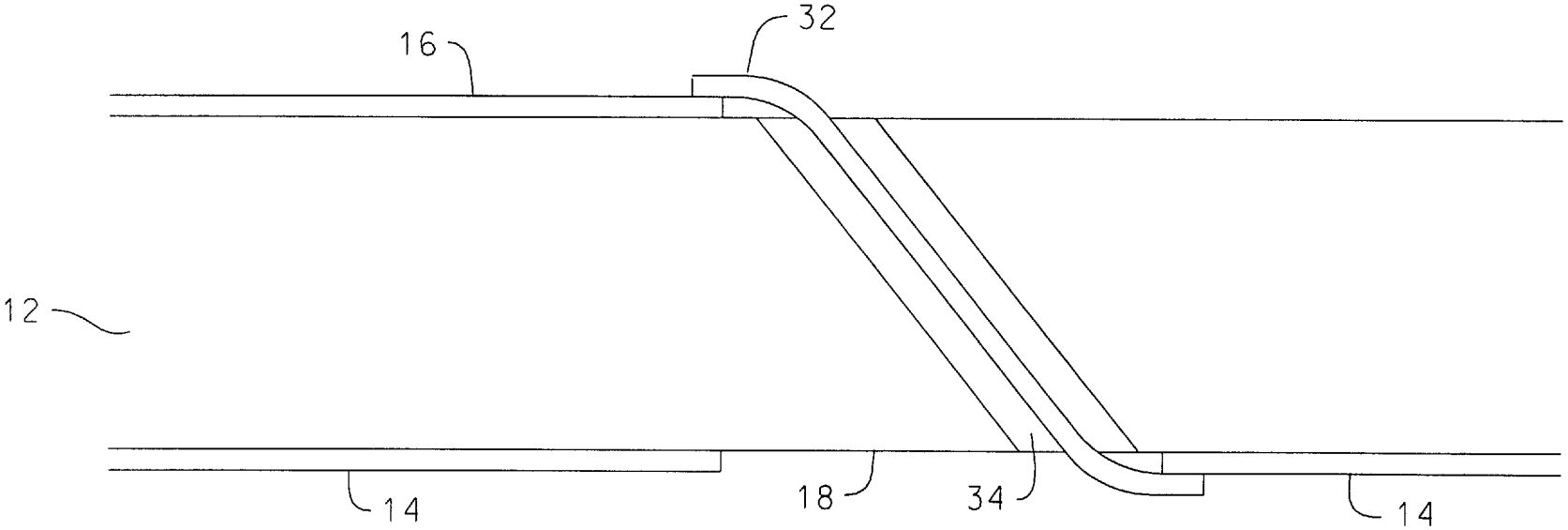
FIG. 4 is an enlarged cross-sectional view of the feed geometry of an alternative embodiment of the slot spiral antenna of FIG. 1.

As shown in FIG. 4, the feed connection can be accomplished by connecting the microstrip line 16 to the conductive layer 14 near the slotline 18 with a jumper 32. The jumper 32 is fed through a slot 34 in the substrate 12. This feed provides better broadband characteristics, but is generally more difficult to fabricate.

Figure 5:
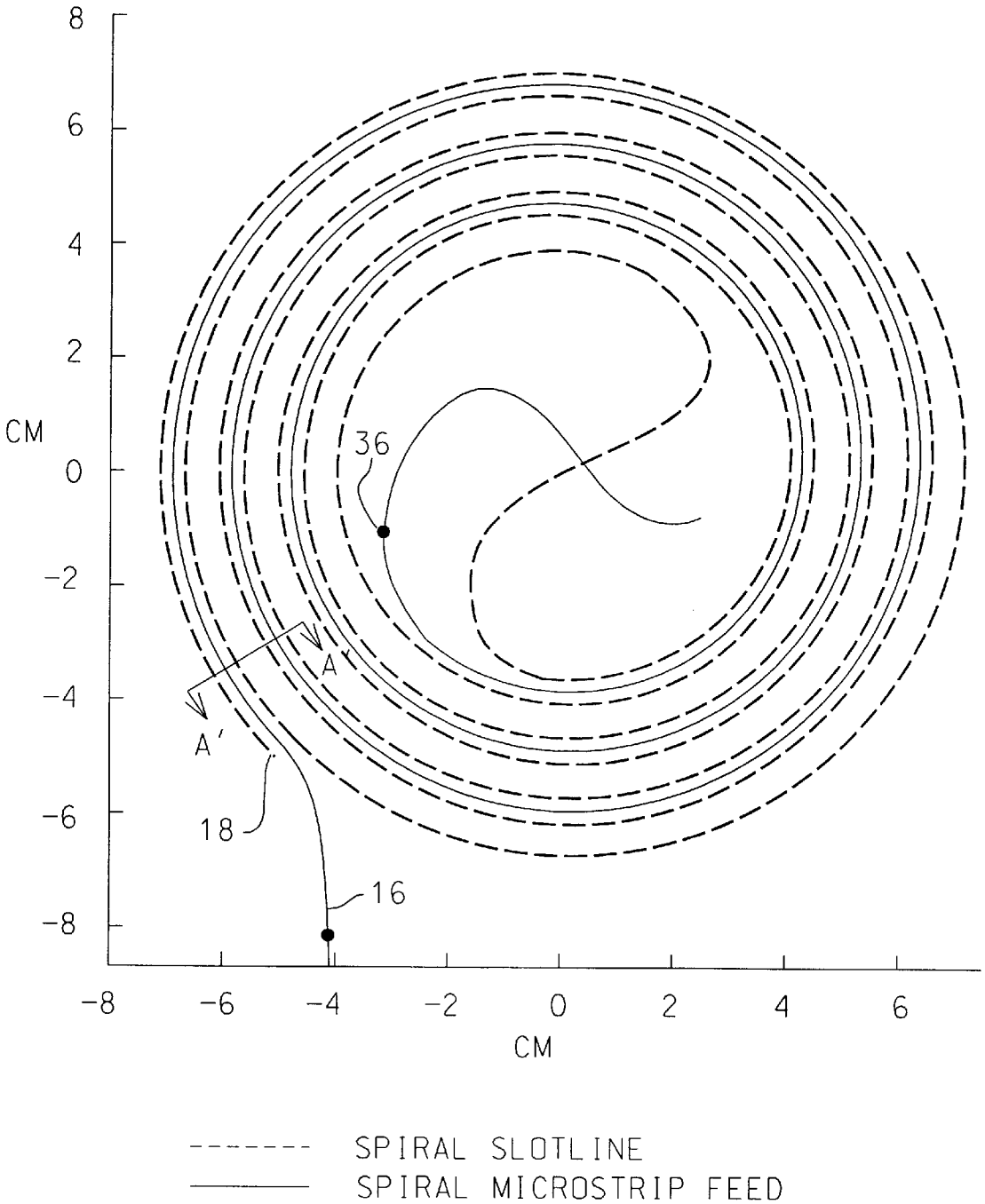
FIG. 5 is a schematic diagram of the spiral slot antenna and microstrip balun/feed showing an alternative embodiment of the feed geometry.

As another example, if the antenna is not to operate at very high frequencies, the center slot spiral loops can be of reduced density, as shown in FIG. 5. This permits the possibility of exciting the microstrip feed at a point 36 within the periphery of the slot spiral. This feed geometry may be desirable for application having particular shape and space constraints. Another possibility is to offset the center of the spiral 22 while keeping the exterior of the spiral fixed, thus moving the microstrip/slotline transition point 22 to one side of center of the spiral. Doing so allows the direction of the radiation pattern of the antenna to be altered in a desired direction.

Further, if desired, each of the arms may be independently fed using the proposed infinite balun design in conjunction with the use of a hybrid device used for relative phase adjustment to satisfy pattern requirements. Other active or passive devices, such as amplifiers, etc., may be incorporated onto the same substrate 12.

The slot spiral may be in any form (Archimedean, logarithmic ,rectangular, etc.) or combination of forms and may be any size, have any number of turns and growth rates. The number of arms in the spiral may also vary. Furthermore, the spiral may contain overlayed patterns such as zig-zaging, arm width modulation, etc., for size reduction and other advantages.

The cavity may have absorbing or reflecting bottom and walls. It can include any combination of material fillings. It may be flat, conical or may be shaped in another manner.

Figure 7:
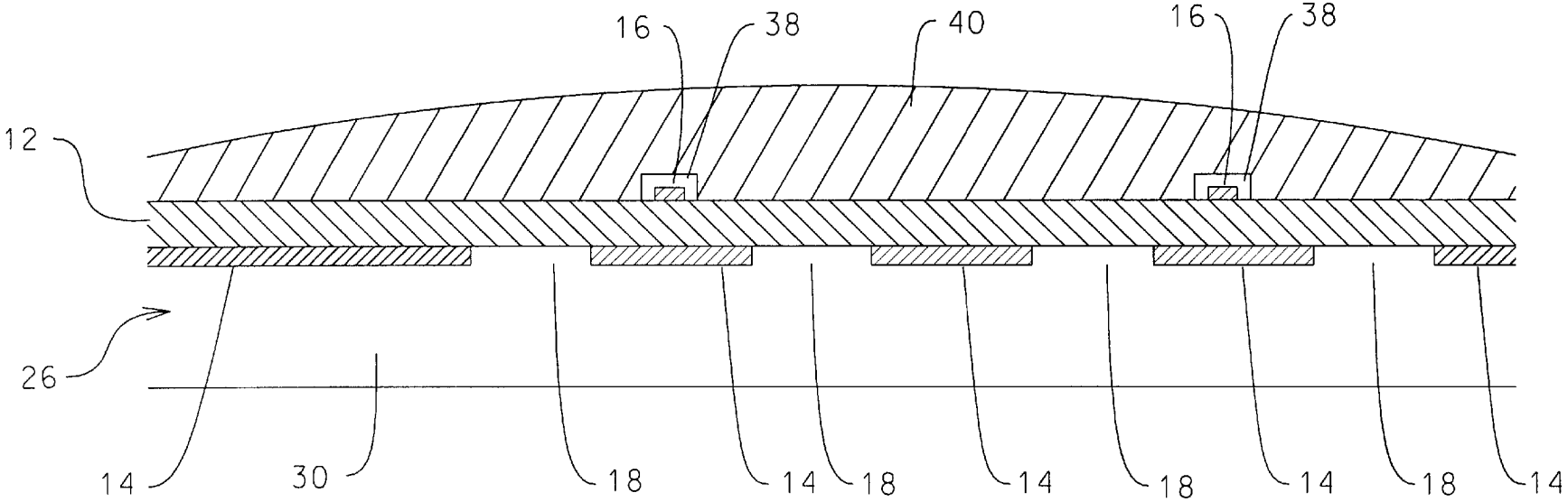
FIG. 7 is an enlarged cross-sectional view of another alternative embodiment of a cavity-backed slot spiral, including a microstrip dielectric lens.

As shown in FIGS. 6 and 7, the inclusion of low loss substrates/superstrates in conjunction with the proposed slot spiral design is very desirable for antenna performance improvements and size reduction. For unidirectional operations, filling the cavity 26 with the low loss material substrate 30 shifts the antenna operation to lower frequencies and is equivalent to reducing the antenna size. Additionally, material layers (superstrates) 36 can be placed on the microstrip feed 16 side of the spiral for further size reduction and pattern control. Furthermore, the superstrate 36 may embody an air-pocket 38 around the microstrip line feed 16 or any other means to ensure that it does not alter the impedance of the feedline 16. Pattern control may be accomplished in connection with magnetic material and appropriate direct current bias. The superstrate 36 on the side of the microstrip feed 16 can be in the form of a dielectric lens 40 to yield higher gain and for additional pattern control, as shown in FIG. 7. The dielectric lens 40 acts to aim and focus the energy like a typical optical lens.

It is to be understood that the invention is not limited to the exact construction illustrated and described above, but that various changes and modifications may be made without departing from the spirit and scope of the invention as defined in the following claims.

We claim:

1. A slot spiral antenna apparatus comprising:

a non-conductive substrate having first and second sides;

a conducting layer on said first side of said substrate, said conducting layer including at least one slotline having a slot arranged along a spiral curve;

a microstrip on said second side of said substrate, said microstrip configured to wind toward the center of said slotline and to provide a balanced feed to said slotline at a feed point to form a radiating element.

2. A slot spiral antenna apparatus according to claim 1 further comprising:

a shallow reflecting cavity having a cavity backing configured to reflect radiation emitted by said radiation element so as to make said radiation element unidirectional.

3. A slot spiral antenna apparatus according to claim 2, wherein said cavity is loaded with a lossy material.

4. A slot spiral antenna apparatus according to claim 2, wherein said cavity is loaded with a low loss material.

5. A slot spiral antenna apparatus according to claim 4 further comprising:

a superstrate layer placed on said second side of said substrate, said superstrate layer having a higher contrast than said low loss material.

6. A slot spiral antenna apparatus according to claim 5 further comprising:

air pockets surrounding said microstrip isolating said microstrip from said superstrate layer.

7. A slot spiral antenna apparatus according to claim 2 wherein said cavity backing is non-planar in shape.

8. A slot spiral antenna apparatus according to claim 7, wherein said microstrip impedance is controlled by tapering the width of said microstrip line.

9. A slot spiral antenna apparatus according to claim 1, wherein said microstrip is configured to have an impedance equal to one-half of the impedance of said slotline at said feed point.

10. A slot spiral antenna apparatus according to claim 1, wherein said slotline further includes ends which are terminated to prevent signal reflections.

11. A slot spiral antenna apparatus according to claim 10 further comprising a lossy material positioned near said ends for terminating said ends.

12. A slot spiral antenna apparatus according to claim 1, wherein said conductive layer acts as a ground plane for said microstrip and said balanced feed is accomplished by breaking said ground plane by allowing said microstrip to pass over said slotline at a feed point at the center of said spiral shaped curve causing electromagnetic coupling between the microstrip and slotline, exciting the slotline without contact between the microstrip and conducting layer.

13. A slot spiral antenna apparatus according to claim 12 wherein said microstrip continues past said feed point to provide wideband matching.

14. A slot spiral antenna apparatus according to claim 13 wherein said microstrip continues past said feed point a distance equal to a multiple of one quarter wavelength of a desired frequency for bandwidth control.

15. A slot spiral antenna apparatus according to claim 13 wherein said microstrip is terminated by a lossy material.

16. A slot spiral antenna apparatus according to claim 1, further comprising a conductive jumper running through a slot in said substrate said jumper connecting said microstrip to an area of said conducting layer near said slotline.

17. A slot spiral antenna apparatus according to claim 1, wherein said conductive layer acts as a ground plane for said microstrip and said balanced feed is accomplished by breaking said ground plane by allowing said microstrip to pass over said slotline at a feed point which is offset from the center of said spiral shaped curve causing electromagnetic coupling between the microstrip and slotline, exciting the slotline without contact between the microstrip and conducting layer, wherein said radiation pattern direction can be controlled by said offset.

18. A slot spiral antenna apparatus according to claim 1 further comprising:

a superstrate layer placed on said second side of said substrate, said superstrate layer being a low loss material.

19. A slot spiral antenna apparatus according to claim 18 wherein said superstrate layer is in the form of a lens and is configured for aiming and focusing radiation produced by said antenna apparatus.

20. A slot spiral antenna apparatus according to claim 1 further comprising means for connecting said antenna to a source.

* * * * *